US005146698A

United States Patent [19]

Tilles et al.

[11] Patent Number: 5,146,698

[45] Date of Patent: Sep. 15, 1992

[54] SHOE INSOLE PROFORM II

[76] Inventors: Harvey G. Tilles, P.O. Box 5466, 614 N. Hamilton, High Point, Guilford, N.C. 27262; Michel Marc, 48 Ridge Hilll Farm Rd., Wellesley, Mass. 02181

[21] Appl. No.: 789,614

[22] Filed: Nov. 8, 1991

Related U.S. Application Data

[63] Continuation of Ser. No. 348,896, May 8, 1989, abandoned.

[51] Int. Cl.[5] ..... A43B 13/40; A43B 13/38

[52] U.S. Cl. ..... 36/44; 36/43; 36/178

[58] Field of Search ..... 36/43, 44, 71, 178, 36/181

[56] References Cited

U.S. PATENT DOCUMENTS

| | | | |
|---|---|---|---|
| 2,423,622 | 7/1947 | Samblanet | 128/619 |
| 2,623,307 | 12/1952 | Morton | 128/619 |
| 4,408,402 | 10/1983 | Looney | 36/44 |
| 4,435,910 | 3/1984 | Marc | 36/44 |
| 4,513,518 | 4/1985 | Jalbert et al. | 36/43 |
| 4,517,981 | 5/1985 | Santopietro et al. | 36/43 |
| 4,580,356 | 4/1986 | David | 36/43 |
| 4,597,196 | 7/1986 | Brown | 36/43 |
| 4,627,178 | 12/1986 | Sullivan et al. | 36/44 |
| 4,633,598 | 1/1987 | Moronaga et al. | 36/44 |
| 4,674,204 | 6/1987 | Sullivan et al. | 36/44 |
| 4,813,159 | 3/1989 | Weiss | 36/44 |
| 4,823,483 | 4/1989 | Chapnick | 36/44 |

FOREIGN PATENT DOCUMENTS

| | | | |
|---|---|---|---|
| 1489605 | 10/1977 | United Kingdom | 36/44 |

*Primary Examiner*—Steven N. Meyers
*Attorney, Agent, or Firm*—Wolf, Greenfield & Sacks

[57] ABSTRACT

A shoe insole formed by a resilient base piece adapted to be disposed primarily at the heel area and having a cupped peripheral wall. A heel piece is disposed within the base piece and constructed for improved shock absorption at the heel. A top cushioning layer is provided and overlies the resilient base piece and heel piece. The top cushioning layer extends over the base piece from the heel area thereof and forwardly of the base piece so as to principally underlie the toe area. The resilient base piece front edge includes at least a segment thereof that terminates at the large toe joint.

31 Claims, 3 Drawing Sheets

32
30
15A
T
3
15B
15
A
15C
10
14
4
4
20
3

19
10
18
14
17
16

32
30
12
19
10
20
17
14

SHOE INSOLE PROFORM II

This application is a continuation of Ser. No. 07/348,896 filed May 8, 1989, now abandoned.

RELATED APPLICATION

This application relates to co-pending application Ser. No. 07/340,751, filed Apr. 20, 1989.

BACKGROUND OF THE INVENTION

1. Field of the Invention

The present invention relates in general to an improved insole for shoes and pertains, more particularly, to an improved insole that is of more simplified construction and that is adapted for use with, for example running shoes, sneakers or the like.

2. Background Discussion

Running shoes are presently constructed using a preformed insole that is adapted to conform to the arch of the foot for improved comfort and support in running. The entire insole is usually preformed with a raised area that is initially molded to conform to the arch. However, once the shoe has been used, sometimes even for only a short period of time the insole loses its preformed support and as a result support is lost particularly for the arch of the foot and also for other rear areas of the foot.

Reference is also now made herein to previously granted U.S. Pat. No. 4,435,910 on a shoe insole.

It is an object of the present invention to provide an improved insole, particularly for running shoes, sneakers or the like and which supplies improved support and comfort for the foot with the support being provided in a substantially permanent manner. In accordance with the invention, the insole is constructed so that the contour of the insole is maintained even after extensive use of the shoe.

Another object of the present invention is to provide an improved insole for running shoes having a heel section that is cupped for capturing the heel of the foot so as to avoid side motion of the foot in the shoe.

Still another object of the present invention is to provide an improved insole for running shoes which permits the insole to conform to the foot of each individual wearer.

A further object of the present invention is to provide an improved insole for running shoes that is light in weight weighing preferably approximately one ounce.

Another object of the present invention is to provide an improved insole for running shoes in which the insole is breathable and anti-bacterial.

Another object of the present invention is to provide an improved insole for running shoes in which the insole is comprised of a combination of different foams including an intermediate foam that displays a substantially perfect memory and that cushions and absorbs shocks. This foam is characterized by retaining its original position even after extensive use of the shoe.

A further object of the present invention is to provide a improved insole that is of more simplified construction and that is in particular characterized by good impact absorption, particularly at the heel area of the insole.

Still another object of the present invention is to provide an improved insole that is in particular adapted for proper support of the foot, particularly ball and toe interface.

SUMMARY OF THE INVENTION

To accomplish the foregoing and other objects features and advantages of the invention, there is provided a shoe insole which is particularly adapted for use in running shoes, running sneakers or the like footwear. This insole is comprised of multiple layers that incorporate a combination of foam materials. There is provide a resilient base piece adapted to conform to the foot and having a base surface, a top surface and cupped periphery for accommodating the heel and extending to the arch area. A heel piece is disposed in a cutout opening in the base piece under the heel for absorption of shock. A top cushioning layer has a portion thereof affixed to and overlying the resilient base piece and heel piece This top cushioning layer has a top surface adapted to receive the foot. The resilient base piece extends from the heel area forwardly to a thin front edge. A top cushioning layer extends over the base piece from the heel area thereof and forwardly of the thin front edge of the base piece to underlie the foot ball and toe area. The resilient base piece front edge includes at least a first segment thereof that terminates at the large toe joint so as to provide optimum comfort and support.

In accordance with additional features of the present invention the resilient base piece has a recess in the top surface extending about the base of the cupped periphery and for accommodating the top cushioning layer. The cupped periphery is comprised of a cupped wall that has ribs on the outer surface thereof and which extend between a top edge of the cupped wall and the base piece base surface. The cupped wall is preferably smooth on its inner surface. The width of the heel piece is less than the width of the base piece at the base and top surfaces. The thickness of the heel piece is substantially the same a the base piece thickness between the top and bottom surfaces thereof so that the bottom of the heel piece is substantially flush with the base piece base surface. The heel piece may be constructed of a visco elastic material. This may be a soft spongy material for shock absorption but further characterized by fast recovery. The resilient base piece may be constructed of a material having a memory such as a polyvinylchloride material. The top cushioning layer preferably has holes therethrouqh between top and bottom surfaces thereof. This top cushioning layer may be of a foam material such as a polyurethane material.

BRIEF DESCRIPTION OF THE DRAWINGS

Numerous other objects, features and advantages of the invention should now become apparent upon a reading of the following detailed description taken in conjunction with the accompanying drawings in which.

DETAILED DESCRIPTION

Figure 1:
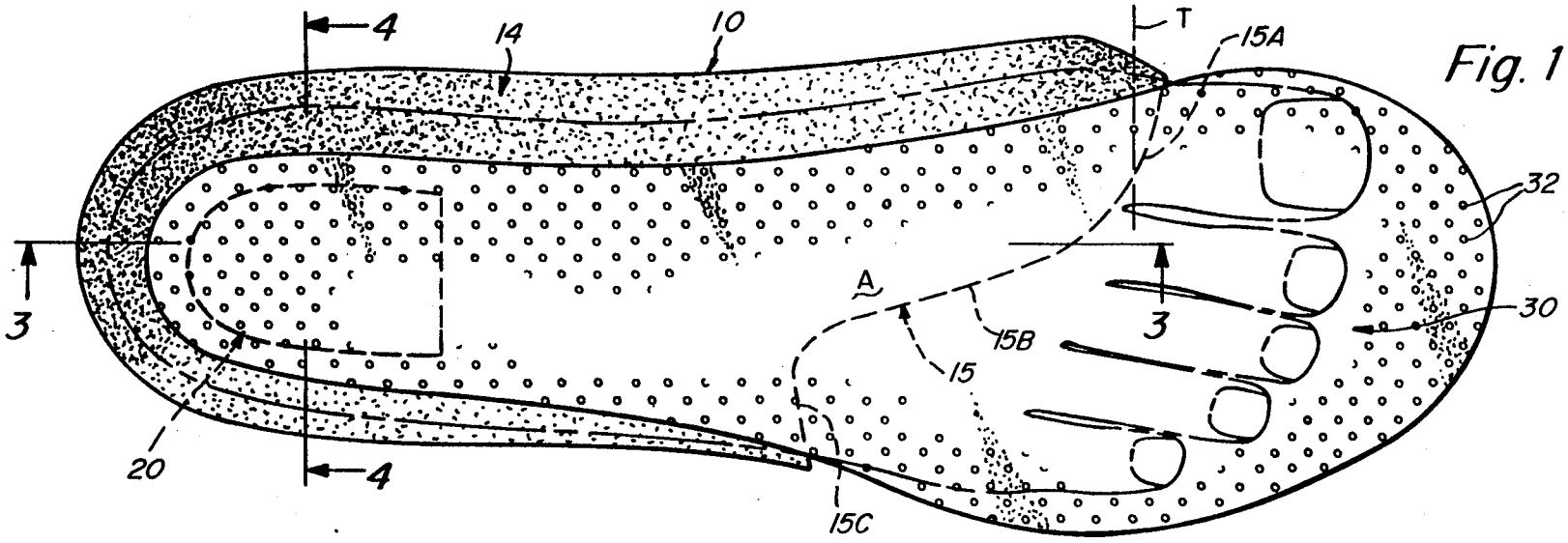
FIG. 1 is a top plan view of the shoe insole of the present invention.

Referring to the drawing, there is shown a preferred embodiment of a shoe insole constructed in accordance with the principles of the present invention and adapted primarily for running shoes. The insole is constructed of a combination of different foam materials and is particularly adapted and constructed so as to provide a foot conforming surface that has a substantially perfect memory and which will retain its formed shape even after extensive use of the running shoe. The insole is also constructed so as to operate effectively in absorbing shock and impact of the foot particularly at the heel area. Furthermore, the insole is constructed so as to provide improved and proper support for the arch of the foot. The arch support is particular, in accordance with the insole of this invention is also maintained even after extensive use of the shoe in which the insole is employed. This insole may also be used either directly in the manufacture of shoes or can be sold separately as an insert to be used with previously worn running shoes.

In particular, in accordance with the present invention there is provided an improved resilient base piece construction that is adapted to extend substantially forwardly, having its front edge, at least in one segment thereof, extending so that it terminates at the large toe joint to provide improved comfort and support for the user Another segment of the front edge of the base piece sweeps rearwardly so that the front edge support primarily surrounds the ball area of the foot.

The drawings herein illustrate a preferred embodiment of the shoe insole. The insole is comprised of a resilient base 10 having a substantially tapered base wall 12 and a substantially cupped peripheral wall 14. The walls 12 and 14 basically accommodate the heel area of the foot and extend toward the arch area.

Figure 3:
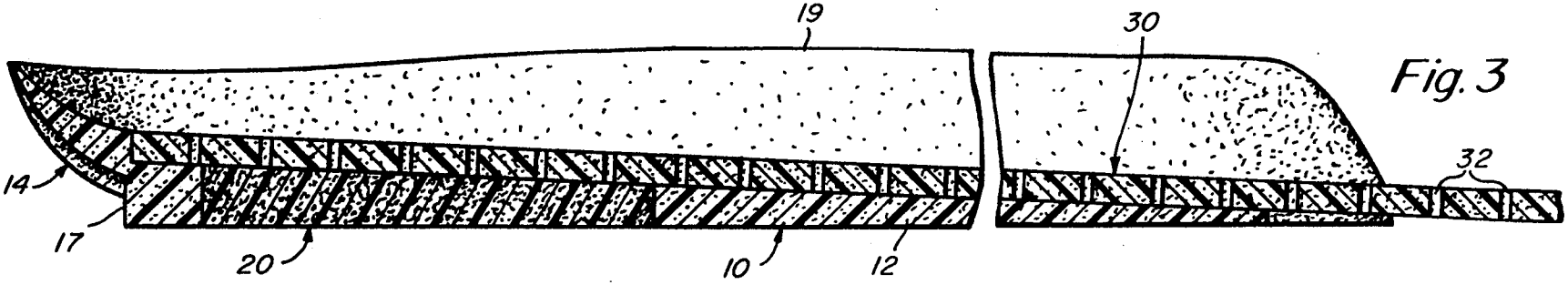
FIG. 3 is cross-sectional view showing further details and as taken along lines 3—3 of FIG. 1.
Figure 4:
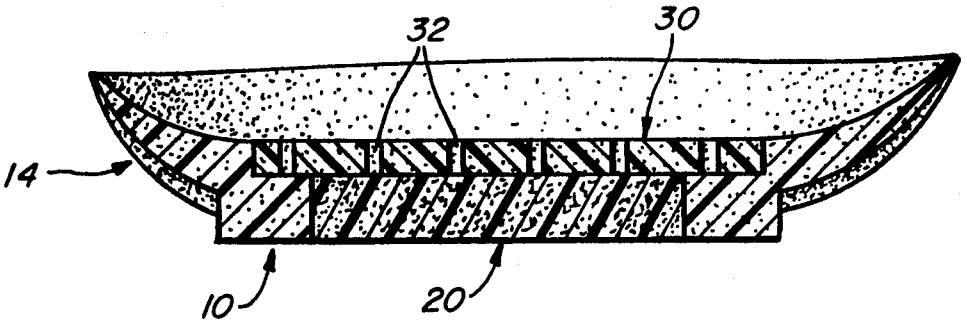
FIG. 4 is a further cross-sectional view taken along line 4—4 of FIG. 1.

As illustrated in, for example, FIG. 3 the base wall 12 is tapered toward a relatively thin front edge 15. In this regard refer to FIGS. 5 and 6 for an illustration of the contour of the front edge 15. Similarly, refer to the perspective view of FIG. 6 for an illustration of the recess 13 in the base piece 10. The recess 13 is of a configuration that essentially matches the contour of the rear portion of the top layer 30 so that the top layer 30 snugly fits in this recess such as is illustrated in, for example, FIGS. 1 and 5.

Figure 5:
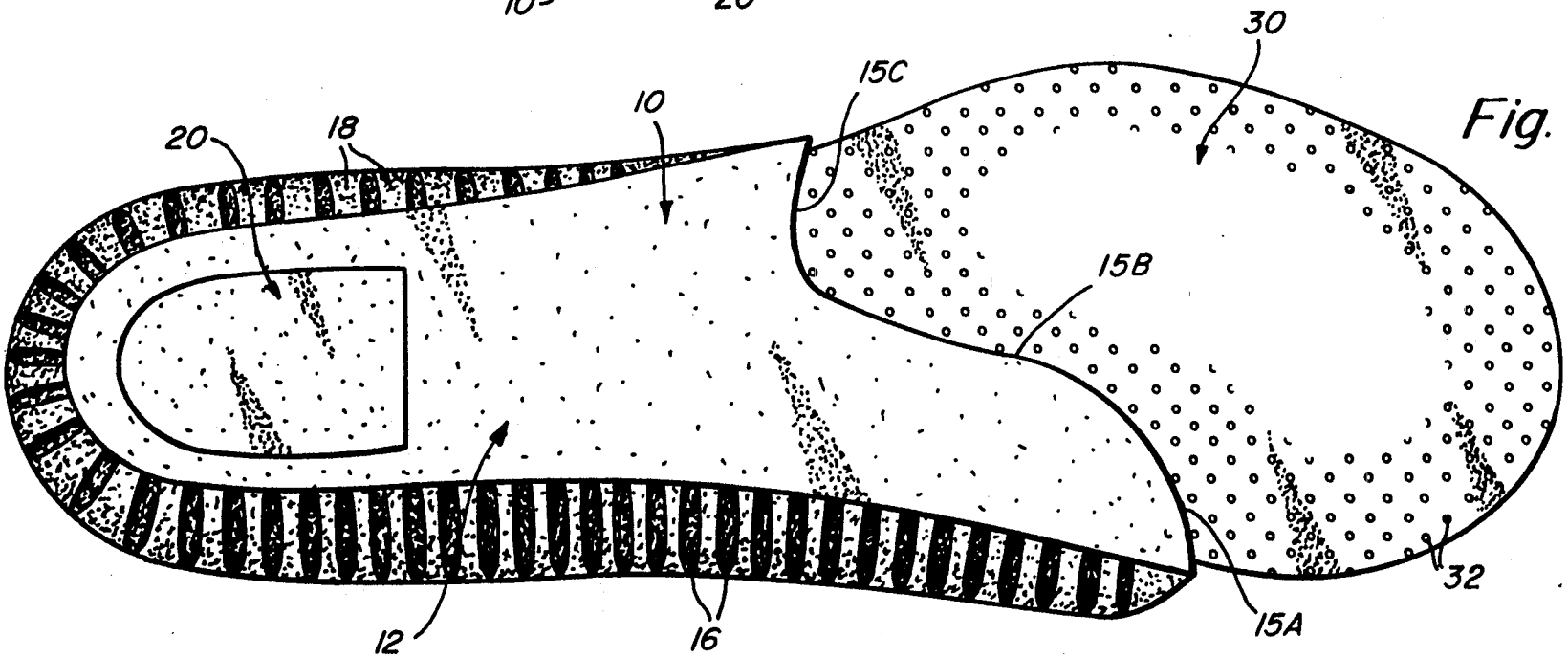
FIG. 5 is a bottom plan view of the shoe insole illustrated in FIGS. 1–4.
Figure 6:
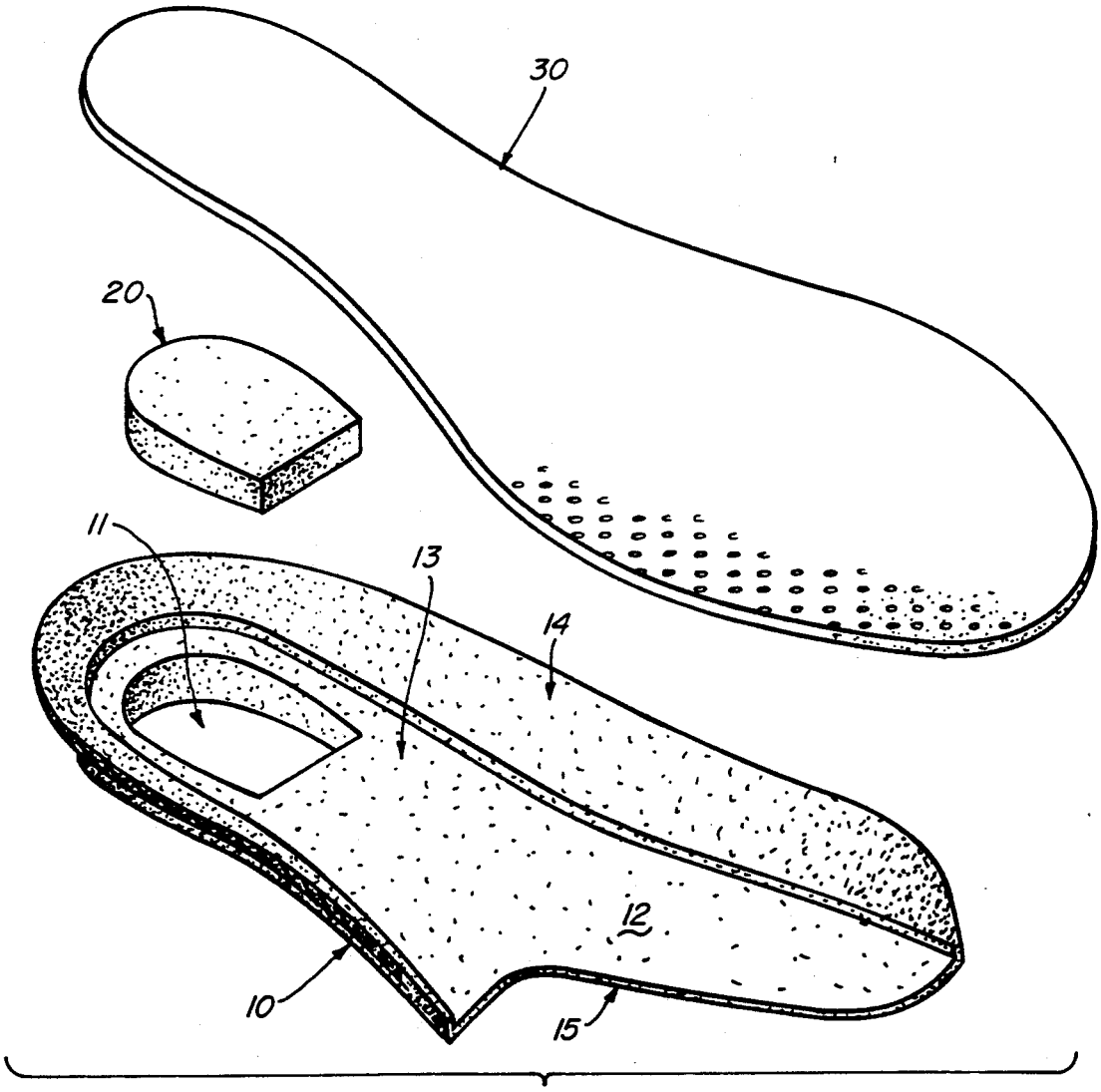
FIG. 6 is an exploded perspective view showing the three basic components of the shoe insole of the present invention.

Reference is now made to FIGS. 1, 5, and 6. There is illustrated therein the contour of the front edge 15 of the base piece. This represents the front edge of the wall 12 thereof. As illustrated FIG. 6, this edge terminates as a relatively thin transitional edge. The front edge 15 has a contour with multiple segments identified in, for example, FIG. 1 as segment 15A, basically at the toe joint location as represented by the dashed line "T" in FIG. 1. A further segment is a rearwardly directed segment 15B and then there is a final segment at a more rear position, namely segment 15C. This contour leaves an area "A" that corresponds substantially to the ball area of the foot. Thus, this contour provides support by the base piece for the ball area of the foot, while at the same time providing the segment 15A terminating substantially at the toe joint, as indicated previously and as represented by the position of line "T" in FIG. 1.

It has been found that this particular multi-segment contour of the front edge provides optimum comfort and support for the foot. The proper support with the use of the ball area "A" of the base piece is provided and the transition at the toe joint provides proper support while at the same time proper comfort to the user.

The position of the segment 15A is preferably in a range of 70%-90% of the overall length of the insole as measured from the heel area thereof and in particular as may be measured from the very heel end of the base wall 12. If the segment 15A were to terminate at a shorter distance then there would not be sufficient support under the ball area of the foot. Termination of the segment 15A at a longer distance would provide discomfort under the large toe.

The cupped peripheral wall 14 is also tapered up to a top edge 19. The inwardly facing surface of the cupped peripheral wall 14 is substantially smooth. It is this surface that may come in contact with the rear part of the foot. As illustrated in, for example, FIG. 2, the outer surface of the cupped peripheral wall 14 is provide with a series of upstanding spacedly disposed recesses 16. These recesses extend from the base edge 17 to terminate just short of the top edge 19. These parallel spaced recesses define therebetween separate spaced ribs 18. The ribs 18 tend to be somewhat wider at the rear of the heel area than at the more forward parts of the cupped peripheral wall.

The base wall 12 of the base piece 10 is also provided, at the heel area, with an opening 11 as illustrated in FIG. 6. The opening 11 extends between the opposite surfaces defining the wall 12. The opening 11 accommodates the heel piece 20. In this regard refer to FIG. 6 and also refer to the somewhat tapered nature of the heel piece 20 as illustrated in FIG. 3. FIG. 3 also illustrates the dimensions of the relative pieces so that the bottom of the heel piece 20 is substantially flush with the bottom of the base piece 10 when the pieces are assembled together.

The base piece 10 is preferably constructed of a foam material. Examples of this material include polyvinylchloride and polyvinylchloride foam. The polyvinylchloride foam functions as a memory and cushions and absorbs shock yet permitting the material to return to its initial position.

The heel piece 20 may also be constructed of a foam material. This material is preferably a visco-elastic compound. The material is preferably a soft spongy material which absorbs shock and yet is characterized by a fast recovery The material of the base piece 10 is generally somewhat stiffer than the material of the heel piece 20. Thus, the heel piece 20 provides, in particular, improved shock absorption directly at the heel of the foot. In this regard, it is noted that the heel piece 20 is primarily disposed only at the heel area of the overall insole.

Finally, there is provided over the base piece 10 and the heel piece 20, the top cushioning layer 30. These various components are connected together with the use of an adhesive. The adhesive is essentially applied between the base piece 10 and the heel piece 20 on the bottom side and the top cushioning layer 30 on the top side. There need not be any gluing or adhesive applied between the base piece 10 and the heel piece 20. Both of these pieces can be held in place simply by the adhesive between these pieces and the underside of the top cushioning layer 30.

Figure 2:
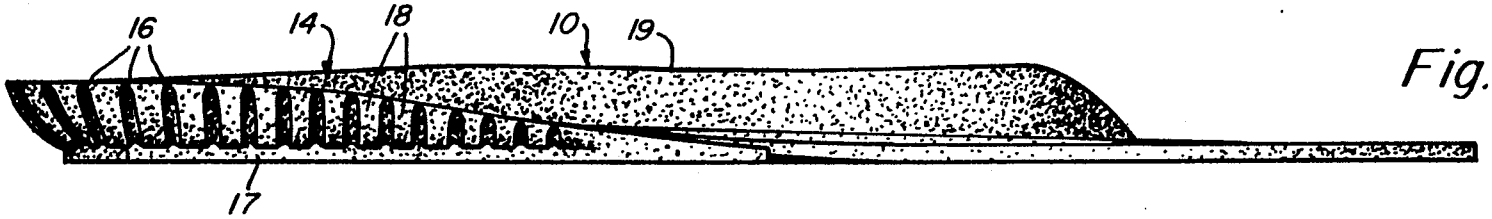
FIG. 2 is a side elevation view of the shoe insole of FIG. 1.

As illustrated, for example, in FIGS. 1, 2 and 5, the top cushioning layer extends beyond the base piece 10, and in particular beyond the front edge 15 thereof. The front portion of the layer 30 would generally underlie the toe area of the foot.

The top cushioning layer 30 is preferably provided with a series of holes 32 therethrouqh. These holes provide for a certain amount of air circulation to permit the foot to breathe.

The top cushioning layer 30 is preferably constructed of a foam material such as neoprene, S.B.R. or polyurethane foam. Anyone of these foam materials is preferably covered on one or both of its top and bottom surfaces with a cloth material such as brushed nylon or cambrelle.

Having now described one embodiment of the present invention, it should now become apparent to those skilled in the art that numerous other embodiments are contemplated as falling within the scope of the present invention. For example, although the embodiment described is used in a running shoe, it is understood that the principles of the invention may also be applied in the construction of other types and forms of shoes including other types of athletic shoes.

What is claimed is:

1. A shoe insole comprising:

a resilient base piece adapted to conform to the foot and having a base surface, a top surface and a cupped periphery for accommodating the heel and extending to the arch area, a heel piece disposed in a cut out opening in the base piece under the heel for absorption of shock, and a top cushioning layer having a portion thereof affixed to and overlying the resilient base piece and heel piece and having a top surface adapted to receive the foot, said top cushioning layer extending over the base piece from the heel area thereof and forwardly beyond a front edge of the base piece to underlie the toe area, said resilient base piece front edge including at least first and second segments thereof;

said first segment extending along the large toe joint from the inside of the foot to the foot ball area;

said second segment contiguous from said first segment and extending rearwardly from the foot ball area such that the large toe joint is substantially the only toe joint along which the resilient base piece front edge extends.

2. A shoe insole as set forth in claim 1 wherein said portion of the top cushioning layer overlying the resilient base piece has a width that is narrower than a width of the resilient base piece;

said base piece having sidewalls extending substantially normally from the top surface thereof and defining a recess within said base piece, said recess substantially conforming in shape to the portion of the top cushioning layer overlying the resilient base piece, said recess having a depth substantially equivalent to a thickness of the top cushioning layer but less than the thickness of the resilient base piece;

the top cushioning layer being positioned within said recess such that the top surface of the top cushioning layer is flush with the cupped periphery of the resilient base piece.

3. A shoe insole as set forth in claim 2 wherein the cupped periphery is comprised of a cupped wall that has ribs of the outer surface thereof and extending between a top edge of the cupped wall and the base piece base surface.

4. A shoe insole as set forth in claim 3 wherein the cupped wall is smooth on its inner surface.

5. A shoe insole as set forth in claim 1 wherein the width of the heel piece is less than the width of the heel area of the base piece.

6. A shoe insole as set forth in claim 5 wherein the thickness of the heel piece is substantially the same as the base piece thickness between top and base surfaces thereof so that the bottom of the heel piece is flush with the base piece base surface.

7. A shoe insole as set forth in claim 6 wherein the heel piece is constructed of a visco-elastic material.

8. A shoe insole as set forth in claim 6 wherein the heel piece is constructed of a soft spongy material for shock absorption with fast recovery.

9. A shoe insole as set forth in claim 1 wherein the resilient base piece is constructed of a material having memory.

10. A shoe insole as set forth in claim 1 wherein the resilient base piece is of a polyvinylchloride material.

11. A shoe insole as set forth in claim 1 wherein the top cushioning layer has holes therethrouqh between top and bottom surfaces.

12. A shoe insole as set forth in claim 1 wherein the top layer is of a foam material.

13. A shoe insole as set forth in claim 12 wherein the foam material is polyurethane with a cloth cover.

14. A shoe insole as set forth in claim 1 wherein the base piece tapers from the heel area to the front edge.

15. A shoe insole as set forth in claim 1 wherein said base piece front edge includes a third segment thereof contiguous from said second segment and extending substantially transverse terminating at the outside of the foot.

16. A shoe insole as set forth in claim 1 wherein said first segment terminates at a position in a range on the order of 70%-90% of the length of the insole as measured from the heel area thereof.

17. A shoe insole comprising:

a resilient base piece adapted to conform to the foot and having a base surface, a top surface and a cupped periphery for accommodating the heel and extending to the arch area, a heel piece disposed in a cut out opening in the base piece under the heel for absorption of shock, and a top cushioning layer having a portion thereof affixed to and overlying the resilient base piece and heel piece and having a top surface adapted to receive the foot, said resilient base piece extending from the heel area forwardly to a thin front edge, said thin front edge having first, second and third segments thereof;

said first segment extending along the large toe joint from the inside of the foot to the foot ball area;

said second segment contiguous from said first segment and extending rearwardly from the foot ball area such that the large toe joint is substantially the only toe joint along which the resilient base piece front edge extends;

said third segment extending slightly rearwardly from the outside of the foot to intersect with said second segment substantially rearward of the toes;

said top cushioning layer extending over the base piece from the heel area thereof and forwardly beyond the thin front edge of the base piece to underlie at least the toe area, said resilient base piece having a base wall and a substantially cupped peripheral wall, said top cushioning layer having a contour substantially matching that of the resilient base piece base wall, the interface between said base piece base wall and said cupped peripheral wall being defined by a recess shoulder that receives said top cushioning layer therein and that is dimensioned so that the top surface of the top cushioning layer is substantially flush with the top surface of the cupped peripheral wall.

18. A shoe insole as claimed in claim 17 wherein the foot ball area extends partially across a width of the base piece from the inside to a ball termination area, said ball termination area being a distance from the inside that is substantially equal to 25% of a distance from the inside across the width of the base piece to the outside, said second segment extending rearwardly from the ball termination area.

19. A shoe insole comprising:

a resilient base piece adapted to conform to the foot and having a base surface, a top surface and a cupped periphery for accommodating the heel and extending to the arch area, a heel piece disposed in a cut out opening in the base piece under the heel for absorption of shock, and a top cushioning layer having a portion thereof affixed to and overlying the resilient base piece and heel piece and having a top surface adapted to receive the foot, said resilient base piece extending from the heel area forwardly to a thin front edge, said thin front edge having first, second and third segments thereof, said first segment terminating at the large toe joint, said second segment extending rearwardly from the foot ball area, said third segment extending substantially normally from said second segment across said base piece and terminating substantially rearwardly of the toes;

said top cushioning layer extending over the base piece from the heel area thereof and forwardly beyond the thin front edge of the base piece to underlie at least the toe area, said resilient base piece having a base wall and a substantially cupped peripheral wall, said top cushioning layer having a contour substantially matching that of the resilient base piece base wall, the interface between said base piece base wall and said cupped peripheral wall being defined by a recess shoulder that receives said top cushioning layer therein and that is dimensioned so that the top surface of the top cushioning layer is substantially flush with the top surface of the cupped peripheral wall.

20. A shoe insole comprising:

a resilient base piece adapted to conform to the foot and having a base surface, a top surface and a cupped periphery for accommodating the heel and extending to the arch area, a heel piece disposed in a cut out opening in the base piece under the heel for absorption of shock, and a top cushioning layer having a portion thereof affixed to and overlying the resilient base piece and heel piece and having a top surface adapted to receive the foot, said resilient base piece extending from the heel area forwardly and terminating at a thin front edge;

said resilient base piece having a base wall and a substantially cupped peripheral wall;

said thin front edge having first, second and third segments thereof, said first segment terminating at the sulcus area of the large toe, said second segment extending rearwardly from the foot ball area, said third segment terminating at the cuboid area and extending substantially normally from said peripheral wall across said base piece;

said top cushioning layer extending over the base piece from the heel area thereof and forwardly beyond the thin front edge of the base piece to underlie at least the toe area, said resilient base piece having a base wall and a substantially cupped peripheral wall.

21. A shoe insole as claimed in claim 20 wherein said peripheral wall terminates at a substantially right angle step at its front edge in the cuboid area.

22. A shoe insole as claimed in claim 21 wherein the interface between said base piece, base wall and said cup peripheral wall is defined by a recess shoulder that receives said top cushioning layer and that at least in part defines said peripheral wall.

23. A shoe insole as claimed in claim 22 wherein said recess shoulder is dimensioned so that the top surface of the top cushioning layer is substantially flush with the top surface of the cupped peripheral wall.

24. A shoe insole comprising:

a resilient base piece adapted to conform to the foot and having a base surface, a top surface and a cupped periphery for accommodating the heel and extending to the arch area, a support piece disposed in a cut out opening in the base piece under the heel for absorption of shock, and a top cushioning layer having a portion thereof affixed to and overlying the resilient base piece and heel piece and having a top surface adapted to receive the foot, said resilient base piece extending from the heel area forwardly to a thin front edge, said thin front edge having first, second and third segments thereof, said first segment extending along the large toe joint from the inside of the foot to the foot ball area, said second segment contiguous from said first segment and extending rearwardly from the foot ball area such that the large toe joint is substantially the only toe joint along which the thin front edge extends, said third segment terminating extending slightly rearwardly from the outside of the foot to intersect with said second segment substantially rearward of the toes;

said top cushioning layer extending over the base piece from the heel area thereof and forwardly beyond the thin front edge of the base piece such that the top cushioning layer is the only portion of the shoe insole to extend beyond the thin front edge forwardly to underlie at least the toe area.

25. A shoe insole as set forth in claim 24 wherein said top cushioning layer has a substantially uniform thickness over its entire length.

26. A shoe insole as set forth in claim 24 wherein said base piece thin front edge tapers so as to be substantially flush with the bottom surface of the top cushioning layer at said thin front edge.

27. A shoe insole comprising:

a resilient base piece adapted to conform to the foot and having a base surface, a top surface and a cupped periphery for accommodating the heel and extending to the arch area, a support piece disposed in a cut out opening in the base piece under the heel for absorption of shock, and a top cushioning layer having a portion thereof affixed to and overlying the resilient base piece and heel piece and having a top surface adapted to receive the foot, said resilient base piece extending from the heel area forwardly to a thin front edge, said thin front edge having at least first and second segments thereof, said first segment extending along the large toe joint from the inside of the foot to the foot ball area, said second segment extending primarily rearwardly at a spaced distance from the inside of the foot in the foot ball area, said spaced distance extending transversely so that said base piece underlies substantially only the foot ball area;

said top cushioning layer extending over the base piece from the heel area thereof and forwardly beyond the thin front edge of the base piece such that the top cushioning layer is the only portion of the shoe insole to extend beyond the thin front edge forwardly to underlie at least the toe area.

28. A shoe insole comprising:

a resilient base piece adapted to conform to the foot and having a base surface, a top surface and a cupped periphery for accommodating the heel and extending to the arch area, a heel piece disposed in a cut out opening in the base piece under the heel for absorption of shock, and a top cushioning layer having a portion thereof affixed to and overlying the resilient base piece and heel piece and having a top surface adapted to receive the foot, said portion of the top cushioning layer overlying the resilient base piece having a width that is narrower than a width of the resilient base piece;

said resilient base piece extending from the heel area forwardly to a thin front edge, said thin front edge having at least first and second segments thereof, said first segment extending along the large toe joint from the inside of the foot to the foot ball area, said second segment contiguous from said first segment and extending rearwardly from the foot ball area such that the large toe joint is substantially the only toe joint along which the thin front edge extends;

said top cushioning layer extending over the base piece from the heel area thereof and forwardly beyond the thin front edge of the base piece to underlie at least the toe area, said base piece having sidewalls extending substantially normally from the top surface thereof and defining a recess within said base piece, said recess substantially conforming in shape to the portion of the top cushioning layer overlying the resilient base piece, said recess having a depth substantially equivalent to a thickness of the top cushioning layer but less than the thickness of the resilient base piece;

the top cushioning layer being positioned within said recess such that the top surface of the top cushioning layer is flush with the cupped periphery of the resilient base piece.

29. A shoe insole comprising:

a resilient base piece adapted to conform to the foot and having a base surface, a top surface and a cupped periphery for accommodating the heel and extending to the arch area, a heel piece disposed in a cut out opening in the base piece under the heel for absorption of shock, and a top cushioning layer having a portion thereof affixed to and overlying the resilient base piece and heel piece and having a top surface adapted to receive the foot, said portion of the top cushioning layer overlying the resilient base piece having a width that is narrower than a width of the resilient base piece;

said resilient base piece extending from the heel area forwardly to a thin front edge, said thin front edge having at least first and second segments thereof, said first segment extending along the large toe joint from the inside of the foot to the foot ball area, said second segment contiguous from said first segment and extending rearwardly from the foot ball area such that the large toe joint is substantially the only toe joint along which the thin front edge extends;

said top cushioning layer extending over the base piece from the heel area thereof and forwardly beyond the thin front edge of the base piece to underlie at least the toe area, said base piece having sidewalls extending substantially normally from the top surface thereof and defining a recess within said base piece, said recess substantially conforming in shape to the portion of the top cushioning layer overlying the resilient base piece, said recess having a depth substantially equivalent to a thickness of the top cushioning layer but less than the thickness of the resilient base piece;

the top cushioning layer being positioned within said recess such that the top surface of the top cushioning layer is flush with the cupped periphery of the resilient base piece, wherein the cupped periphery is comprised of a cupped wall that has ribs of the outer surface thereof and extending between a top edge of the cupped wall and the base piece base surface, wherein the cupped wall is smooth on its inner surface wherein the width of the heel piece is less than the width of the heel area of the base piece, wherein the thickness of the heel piece is substantially the same as the base piece thickness between top and base surfaces thereof so that the bottom of the heel piece is flush with the base piece base surface, and wherein the heel piece is constructed of a visco-elastic material.

30. A shoe insole comprising:

a resilient base piece adapted to conform to the foot and having a base surface, a top surface and a cupped periphery for accommodating the heel and extending to the arch area, a heel piece disposed in a cut out opening in the base piece under the heel for absorption of shock, and a top cushioning layer having a portion thereof affixed to and overlying the resilient base piece and heel piece and having a top surface adapted to receive the foot, said resilient base piece extending from the heel area forwardly to a thin front edge that terminates short of a front edge of the top cushioning layer, said thin front edge having at least first and second segments thereof, said first segment extending along the large toe joint from the inside of the foot to the foot ball area, said second segment contiguous from said first segment and extending rearwardly from the foot ball area such that the large toe joint is substantially the only toe joint along which the thin front edge extends;

said top cushioning layer extending over the base piece from the heel area thereof and forwardly beyond the thin front edge of the base piece to underlie at least the toe area, said resilient base piece having a base wall and a substantially cupped peripheral wall, said top cushioning layer having a contour substantially matching that of the resilient base piece base wall, the interface between said base piece base wall and said cupped peripheral wall being defined by a recess shoulder that receives said top cushioning layer therein and that is dimensioned so that the top surface of the top cushioning layer is substantially flush with the top surface of the cupped peripheral wall.

31. A shoe insole comprising:

a resilient base piece adapted to conform to the foot and having a base surface, a top surface and a cupped periphery for accommodating the heel and extending to the arch area, a heel piece disposed in a cut out opening in the base piece under the heel for absorption of shock, and a top cushioning layer having a portion thereof affixed to and overlying the resilient base piece and heel piece and having a top surface adapted to receive the foot, said resilient base piece extending from the heel area forwardly to a thin front edge that terminates short of a front edge of the top cushioning layer, said thin front edge having at least first and second segments thereof, said first segment extending along the large toe joint from the inside of the foot to the foot ball area, said second segment contiguous from said first segment and extending rearwardly from the foot ball area such that the large toe joint is substantially the only toe joint along which the thin front edge extends;

said top cushioning layer extending over the base piece from the heel area thereof and forwardly beyond the thin front edge of the base piece to underlie at least the toe area, said resilient base piece having a base wall and a substantially cupped peripheral wall, said top cushioning layer having a width in the heel portion thereof that is narrower than a width of the base piece in the heel portion thereof so that the base piece cupped peripheral wall extends beyond the width of the top cushioning layer, the interface between said base piece base wall and said cupped peripheral wall being defined by a recess shoulder that receives said top cushioning layer therein and that is dimensioned so that the top surface of the top cushioning layer is substantially flush with the top surface of the cupped peripheral wall.

* * * * *